US006074082A

United States Patent [19]

Gilbert

[11] Patent Number: 6,074,082

[45] **Date of Patent: *Jun. 13, 2000**

[54] SINGLE SUPPLY ANALOG MULTIPLIER

[75] Inventor: Barrie Gilbert, Portland, Oreg.

[73] Assignee: Analog Devices, Inc., Norwood, Mass.

[ * ] Notice: This patent is subject to a terminal disclaimer.

[21] Appl. No.: 08/478,255

[22] Filed: Jun. 7, 1995

[51] Int. Cl.[7] ..... G06G 7/16

[52] U.S. Cl. ..... 364/841; 327/356

[58] Field of Search ..... 364/841; 327/356

[56] References Cited

PUBLICATIONS

"Analog IC design: the current–mode approach," by Barrie Gilbert, Chapter 2, pp. 11–39 and 52–91, 1990.

"Analog IC design: the current–mode approach," by Barrie Gilbert, Chapter 6, pp. 239–296, 1990.

*Primary Examiner*—Tan V. Mai

*Attorney, Agent, or Firm*—Marger Johnson & McCollom, P.C.

[57] ABSTRACT

An analog multiplier includes a new circuit topology, which includes coupling an amplifier between the collector of one of the input transistors and the bases of the other two input transistors. The amplifier used in the new topology is a double emitter-follower. The collector currents in the other two input transistors are "forced" using the conventional topology but by a simple two transistor forcing circuit comprising a Darlington emitter-follower pair rather than the conventional operational amplifier. The simple forcing circuits allow the multiplier to be used in very low voltage applications having only a single supply voltage. Voltage to current converters can be used on the front end to convert voltage input signals to current input signals, which are then provided to the analog multiplier. The voltage to current converter uses a pre-biasing scheme to produce a linear relationship between the input voltages and the input currents across the entire voltage range of the input voltages. At the back end of the multiplier, current to voltage converters can be added to convert the current output of the multiplier to a corresponding voltage output.

23 Claims, 4 Drawing Sheets

SINGLE SUPPLY ANALOG MULTIPLIER

BACKGROUND OF THE INVENTION

This invention relates to multipliers and more particularly analog multipliers.

Analog multipliers are well known in the art. No so well known is the fact that analog multipliers operate on the so-called "translinear" principle. Barrie Gilbert, *Current-mode Circuits From a Translinear Viewpoint,* in CURRENT-MODE ANALOG INTEGRATED CIRCUIT DESIGN 11–91, (C. Toumazou et al. eds. 1990), incorporated herein by reference. The principle of translinearity states that, for a closed loop of PN junctions, the product of the current-densities in the clockwise direction is equal to the product densities in the counter-clockwise direction. For a loop of transistors having equal junction (emitter) areas, this relationship extends to the currents through the PN junctions as well.

FIG. 1 shows an example of a prior art analog multiplier 10. The multiplier 10 includes three input transistors Q1–Q3 and an output transistor Q4. In the multiplier 10, a relationship between the output current $I_G$ and the input currents $I_1$, $I_2$, and $I_3$ can be derived using the translinear principle where the clockwise loop includes the base-to-emitter junctions of transistors Q3 and Q4 and the counter-clockwise loop includes the base-to-emitter junctions of transistors Q1 and Q2. For the case where the emitter areas of Q1–Q4 are equal, the currents $I_1$, $I_2$, $I_3$, and $I_G$ can then be expressed by the following relationship:

$$I_1 I_2 = I_3 I_G, \tag{1}$$

Rearranging the above relationship produces the following classical expression for the multiplier output current $I_G$:

$$I_G = I_1 \times I_2 / I_3. \tag{2}$$

From equation 2 it is seen that the output current $I_G$ is proportional to the input currents $I_1$, $I_2$ and inversely proportional to the current $I_3$.

The expression assumes that the input currents $I_1$, $I_2$, $I_3$ are exactly replicated in the emitters of the corresponding transistors. Operational amplifiers (op-amps) 12, 14 and 16 are connected between the collector and the emitter of an associated transistor to "force" the collector currents in the associated transistors to be equal to the input currents $I_1$, $I_2$, $I_3$. (See Gilbert, CURRENT-MODE ANALOG INTEGRATED CIRCUIT DESIGN at 37.) The op-amps force the collector currents equal to the input currents even for low values of current-gain, beta ($\beta = I_C/I_B$). The op-amps thus provide added robustness to the analog multiplier across semiconductor process variations.

A problem with this design is that the operational amplifiers add significant complexity to the four transistor analog multiplier 10. Accordingly, a need remains a simple, yet robust, analog multiplier circuit.

SUMMARY OF THE INVENTION

It is therefore an object of the invention to provide a simple analog multiplier circuit.

The analog multiplier according to the invention includes a new circuit topology to that shown in the prior art. The new topology includes coupling an amplifier between the collector of one of the input transistors and the bases of the other two input transistors. In addition, the amplifiers used in the new topology are simple emitter follower, each of which requires only a single transistor. An additional emitter-follower can be used in these amplifiers to form a double emitter-follower, which is used in the preferred embodiment. The collector currents in the other two input transistors are "forced" using the conventional topology but by a simple two transistor forcing circuit rather than the conventional operational amplifier used in the prior art. Therefore, the invention produces a simple analog multiplier without the use of operational amplifiers to force the currents. The new topology along with the simplified forcing circuits allow the multiplier of the present invention to operate with a single supply voltage.

The foregoing and other objects, features and advantages of the invention will become more readily apparent in the following detailed description of a preferred embodiment of the invention which proceeds with the reference to the accompanying drawings.

DETAILED DESCRIPTION

Figure 1:
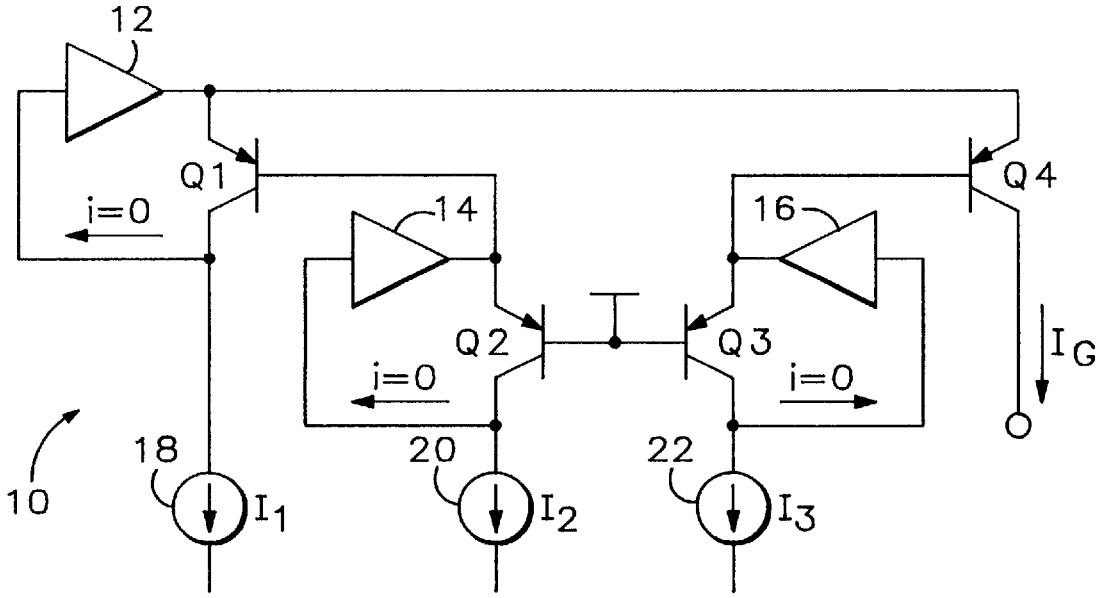
Fig.1 (PRIOR ART)
FIG. 1 is a prior art schematic of an analog multiplier circuit.
Figure 2:
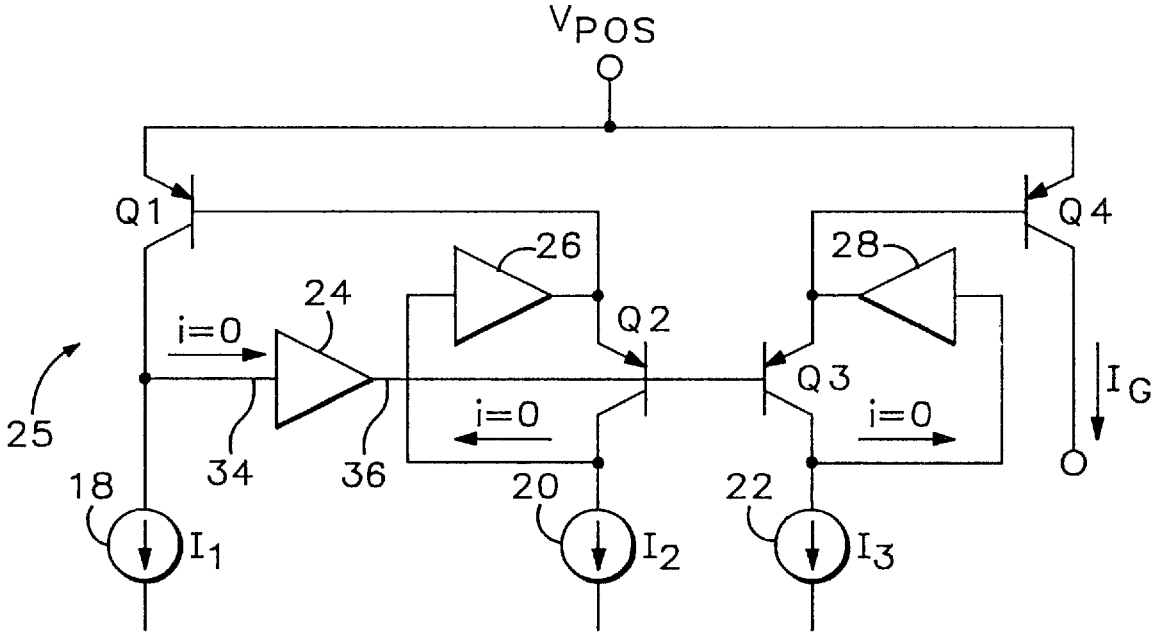
FIG. 2 is a schematic diagram of the analog multiplier circuit according to the invention showing the new circuit topology.

Referring now to FIG. 2, a schematic diagram of an analog multiplier circuit 25 according to the invention is shown. The multiplier 25 incorporates a new circuit topology according to the invention, among other things. The new circuit topology, as can be seen by comparing FIGS. 1 and 2, includes an amplifier circuit 24 coupled between the collector of input transistor Q1 and the bases of the two remaining input transistors Q2 and Q3. The amplifier circuit 24 forces the collector current in transistor Q1 to be equal to the input current $I_1$ generated by current source 18. The amplifier circuit 24 is included to pull down on the common bases of transistors Q2 and Q3 responsive to the input current $I_1$ and thus turns on all the transistors. Amplifier 24 is required because of the finite betas of Q2 and Q3. If the betas of transistors Q2 and Q3 are sufficiently high, however, amplifier 24 is not required.

Figure 3:
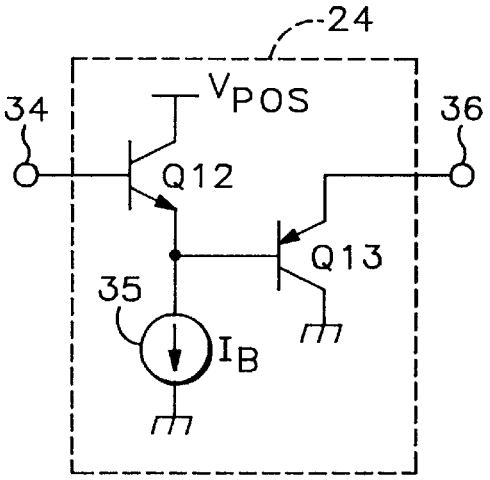
FIG. 3 is a schematic of the amplifier circuit used in the multiplier circuit of FIG. 2.

The amplifier circuit 24 is shown in detail in FIG. 3. The amplifier 24 is a much simpler design than the op-amp used in the prior art. The amplifier includes an NPN emitter-follower transistor Q12 biased by a current source 35. The base of transistor Q12 forms an input terminal 34 of the amplifier 24, which is coupled to the collector of Q1 in FIG. 2. An optional PNP emitter-follower transistor Q13 is coupled between the emitter of Q12 and an output terminal 36. The two transistors Q12 and Q13, therefore, form a double emitter-follower. PNP transistor Q13, in addition, provides a level shifting effect to account for the voltage drop across Q12. The single or dual-emitter followed is augmentation that is not essential to the operation of the invention.

Figure 4:
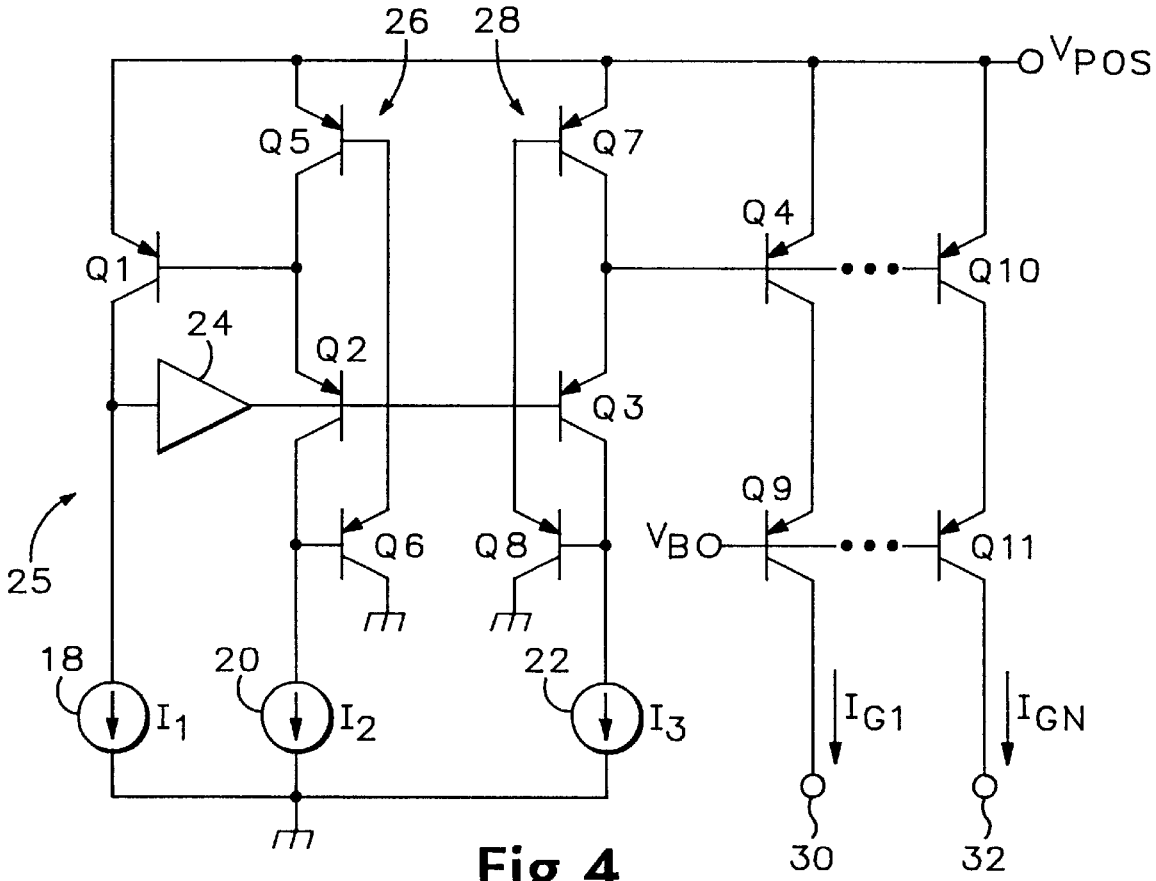
FIG. 4 is a detailed schematic diagram of the analog multiplier circuit of FIG. 2.

The collector currents of input transistors Q2 and Q3 are forced using the conventional topology, as shown in FIG. 1. The operational amplifiers 14 and 16 of FIG. 1, however, have been replaced by simple two transistor forcing circuits 26 and 28, as shown in detail in FIG. 4. The forcing circuit 26 includes two PNP transistors Q5 and Q6 arranged in a Darlington emitter-follower configuration. Forcing circuit 28, comprised of transistors Q7 and Q8, operates in substantially the same manner to force the collector current in Q3. The forcing circuits 26 and 28 maintain accurate operation of the multiplier independently of variations in transistor beta values by effectively biasing the transistor independently of the base current to the respective input transistor. Capacitors can be included across the base-to-emitter junctions of Q6 and Q8 to ensure HF stability.

The single output transistor Q4 of the prior art has been augmented by a cascode transistor Q9, which is biased by a cascode bias voltage $V_B$. The cascode transistor Q9 minimizes the variation in collector voltage of Q4 due to varying output voltages at node 30. Additional output transistor/cascode transistor pairs such as Q10/Q11 can be added to provide, in general, N output currents ($I_{G1}$ through $I_{GN}$), each having the same multiplicative relationship to the input currents ($I_1$ through $I_3$). In that case, the bases of output transistors Q4 and Q10 are coupled together as are the bases of cascode transistors Q9 and Q11.

Figure 5:
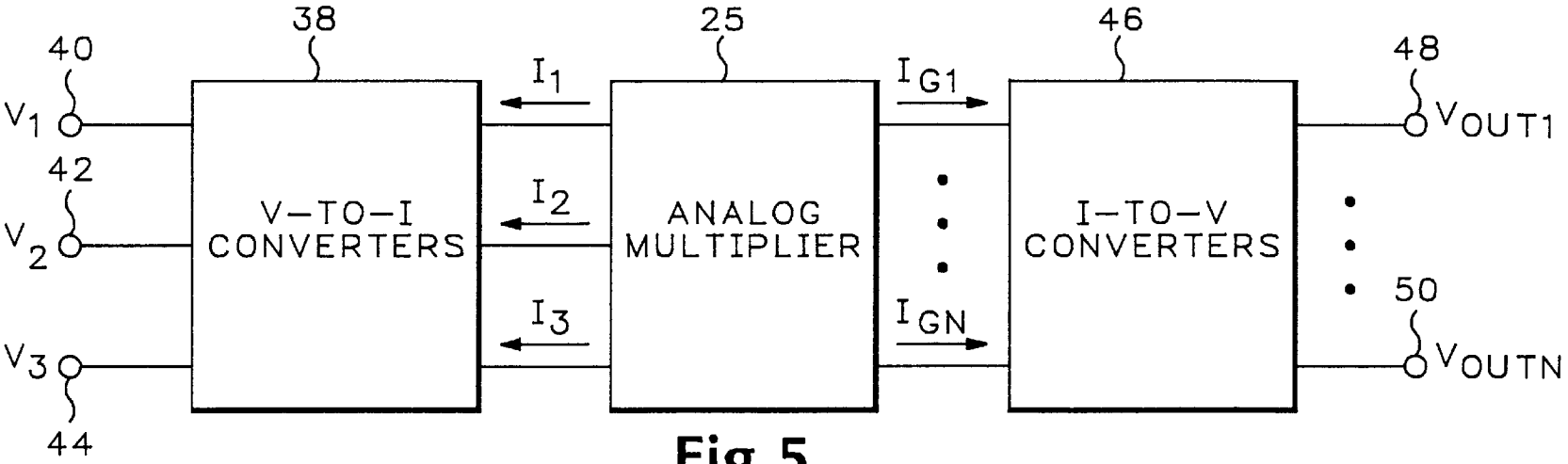
FIG. 5 is a block diagram of a voltage based version of the analog multiplier of FIG. 2.

Referring now to FIG. 5, a block diagram of a voltage based version of the analog multiplier of FIG. 2 is shown. The voltage-based version receives voltage inputs ($V_1$ through $V_3$) and produces one or more voltage outputs ($V_{OUT1}$ through $V_{OUTN}$). In contrast, the analog multiplier 25 receives current inputs ($I_1$ through $I_3$) and produces one or more current outputs ($I_{G1}$ through $I_{GN}$). The voltage-based version includes voltage-to-current (V-to-I) converters 38, which includes three input terminals 40, 42, and 44 that receive the voltage inputs $V_1$, $V_2$ and $V_3$, respectively. The V-to-I converters 38, as the name implies, converts the input voltages $V_1$, $V_2$ and $V_3$ to corresponding input currents $I_1$, $I_2$, and $I_3$. These input currents are then provided to the analog multiplier 25 shown in FIG. 4, which combines the input currents to produce one or more output currents $I_{G1}$ through $I_{GN}$ in the manner described above. These output currents may then converted to corresponding output voltages $V_{OUT1}$ through $V_{OUTN}$ by a current-to-voltage converters (I-to-V) 46 coupled to the multiplier 25.

Figure 6:
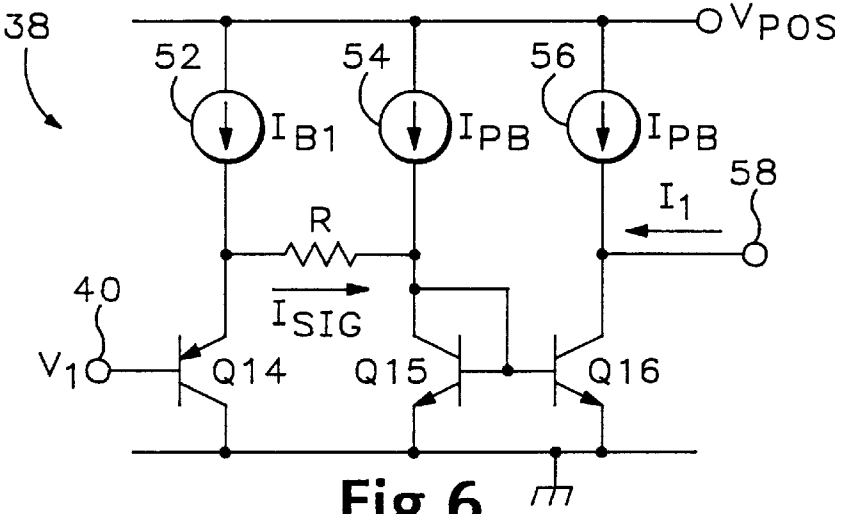
FIG. 6 is a schematic diagram of the voltage-to-current converter of FIG. 5.

Referring now to FIG. 6, a circuit portion 51 of the V-to-I converter 38 is shown. This portion 51 converts the voltage input signal $V_1$ received at input terminal 40 to a corresponding current $I_1$ at terminal 58. The converter 38 therefore comprises three such portions, one portion for each of the voltage inputs $V_1$ through $V_3$. Only one portion 51 is shown and described, however, to simplify the drawing.

The circuit portion 51 includes an input emitter follower Q14 and a current mirror comprised of transistors Q15 and Q16. The emitter follower Q14 is biased by a current source 52, which provides a bias current $I_{B1}$ to Q14. A resistor R is coupled between the emitter of Q14 and the collector of Q15 through which a signal current $I_{SIG}$ passes essentially proportional to voltage $V_1$ measured relative to the ground node.

The transistor Q15 in the current mirror is pre-biased by the current source 54, which provides a bias current of $I_{PB}$ to this transistor. The current mirror operates in the conventional manner producing an output current ($I_{PB}+I_{SIG}$) in the collector of Q16 that is closely equal to the current in the collector of Q15 in the usual manner of a current mirror. A similar current 56 is then subtracted from the collector current of Q16 to generate the output current $I_1$ at node 58. The pre-bias currents establish a more linear relationship between the input voltage $V_1$ and the corresponding current $I_1$ across the full range of the input voltage (e.g., 0–2V).

To understand this result consider the initial case where the input voltage is zero volts. In this case, a base-to-emitter voltage $V_{BE}$ is established across both transistors Q14 and Q15 by the bias currents $I_{B1}$ and $I_{PB}$, respectively. If the junction saturation currents ($I_S$) are approximately equal and current $I_{B1}$ is approximately equal to $I_{PB}$, then the voltage across resistor R is also zero because the base-to-emitter voltages of Q14 and Q15 are equal. Thus, the current $I_{SIG}$ through the resistor R is equal to zero. As a result, the current $I_1$, which is equal to $I_{SIG}$, is also zero. If the pre-bias currents are not included, the relationship between the input voltage $V_1$ and the current $I_1$ is non-linear or "soft" at the bottom end of the voltage range. If, however, the input voltages do not extend into this "soft" range, such as where one or more of the voltage inputs is held constant, the pre-biasing scheme can be eliminated.

The design of the V-to-I converter 38 was motivated in part by the input requirements of the analog multiplier 25, which it interfaces to. For instance, the current mirror was implemented in NPN transistors because the input current $I_1$–$I_3$ flow into the converter 38. It should be apparent that the converter can be implemented using complementary transistors (PNP versus NPN and vice-versa) if the currents were required to flow in the opposite direction, such as would be required for the NPN version of the multiplier shown in FIG. 8.

Figure 7:
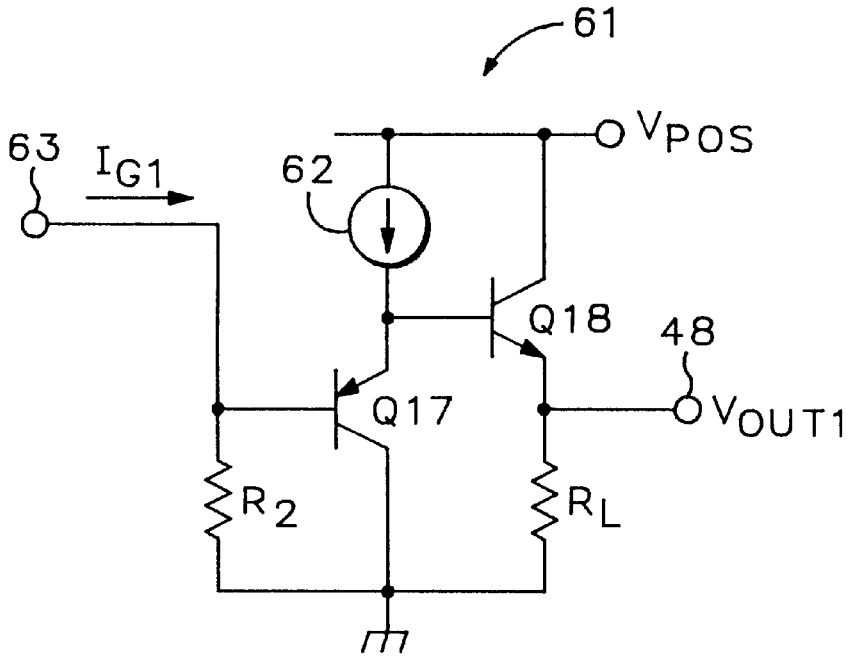
FIG. 7 is a schematic diagram of current-to-voltage converter of FIG. 5.

Referring now to FIG. 7, a circuit portion 61 of the current to voltage converter 46 is shown. As with FIG. 6, only a portion 61 of the converter 46 is shown for illustrative purposes. The portion 61 converts a single output current $I_{G1}$ to a corresponding output voltage $V_{OUT1}$. An additional portion is required for each additional output current (i.e., $I_{G2}$–$I_{GN}$). The circuit portion 61 includes a resistor R2 through which the output current $I_{G1}$ flows. The resistor R2 itself does establish a voltage across it. However, instead of using the resistor R2 as the converter, the portion 61 includes a double emitter follower pair comprised of transistors Q17 and Q18. The PNP emitter follower Q17 is appropriately biased by current source 62 while NPN emitter follower Q18 is loaded by a load resistor $R_L$. The double emitter follower allows a substantial load current to flow through $R_L$.

The addition of the voltage-to-current converter 38 and the current-to-voltage converter 46 thus allow the analog multiplier 25 to interface into voltage based applications. It is apparent that either the converter 38 or converter 46, or both, can be eliminated depending on the interfacing requirements of the application. An advantage of this design is that it can be implemented in a single voltage supply system because of the minimal voltage drop across the entire circuit.

Having described and illustrated principles of the invention in a preferred embodiment thereof, it should be apparent that the invention can be modified in arrangement and detail without departing from such principles. For example, the above description has been based on a so-called balanced or "B Type" multiplier as defined in Gilbert, CURRENT-MODE ANALOG INTEGRATED CIRCUIT DESIGN at 55–56. It will be apparent to those skilled in the art based on the description contained herein that the invention can be extended to the alternating or "A Type" multipliers, in which the PN junctions alternate around the translinear loop, with the appropriate rearrangement of the components.

Figure 8:
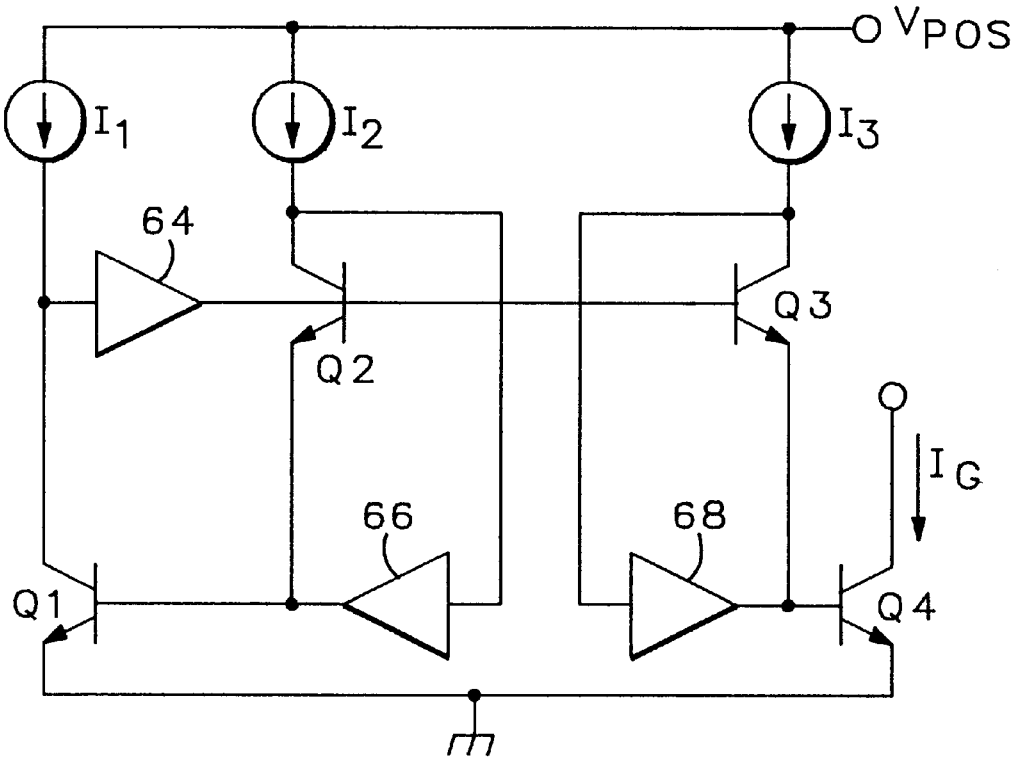
FIG. 8 is a schematic diagram of an alternative embodiment of the analog multiplier circuit according to the invention.

Also, the preferred embodiment of the invention has been described with reference to a certain arrangement of PNP and NPN transistors. It will be apparent to those skilled in the art based on the description contained herein that complementary circuits to those circuits shown above can be implemented by substituting NPN for PNP and vice-versa, where appropriate. An example this is shown in FIG. 8 where an alternative embodiment of the invention is shown which uses NPN transistors in place of the PNP transistors of the analog multiplier. The arrangement of the transistors in the forcing circuits 64, 66 and 68 would be modified accordingly. Furthermore, the invention is not limited to bipolar transistors but can be implemented using bi-CMOS, NMOS, PMOS, as well as using field effect transistors (FETs). We claim all modifications and variations coming within the spirit and scope of the following claims.

What is claimed is:

1. An analog multiplier circuit comprising:

an analog multiplier having three input terminals for receiving associated analog current input signals and an analog output terminal for producing an analog output signal that is proportion to two of the current input signals and inversely proportional to a third current input signal, the multiplier including first, second and third input transistors and an output transistor, each transistor having an input terminal, an output terminal and a control terminal;

a first forcing circuit coupled between the input terminal and the output terminal of the first input transistor;

a second forcing circuit coupled between the input terminal and the output terminal of the second input transistor; and a third forcing circuit coupled between the input terminal of the third input transistor and the control terminals of the first and second input transistors.

2. A circuit according to claim 1 wherein the first forcing circuit includes:

a first forcing transistor coupled to the input terminal of the first input transistor; and a second forcing transistor coupled to between the first transistor and the output terminal of the first input transistor.

3. A circuit according to claim 1 wherein the first forcing transistor includes:

a base coupled to the input terminal of the first input transistor, a collector coupled to a first supply voltage terminal, and an emitter; and wherein the second forcing transistor includes a base coupled to the emitter of the first forcing transistor, a collector coupled to the output terminal of the first input transistor, and an emitter coupled to a second supply voltage terminal, and an emitter.

4. A circuit according to claim 1 wherein the second forcing circuit includes:

a first forcing transistor coupled to the input terminal of the first input transistor; and a second forcing transistor coupled to between the first transistor and the output terminal of the first input transistor.

5. A circuit according to claim 1 wherein the third forcing circuit includes a double emitter-follower circuit coupled between the input terminal of the third input transistor and the bases of the first and second input transistors.

6. A circuit according to claim 1 wherein the double emitter-follower circuit includes:

a first emitter follower having an input coupled to the input terminal of the third input transistor and an output;

a current source coupled to the output of the first emitter follower for biasing the first emitter follower; and a second emitter follower having an input coupled to the output of the first emitter follower and an output coupled to the bases of the first and second input transistors.

7. A circuit according to claim 6 wherein the first emitter follower includes an NPN bipolar transistor.

8. A circuit according to claim 6 wherein the second emitter follower includes a PNP bipolar transistor.

9. A circuit according to claim 6 wherein the analog multiplier includes a cascode transistor interposed between the output transistor and the output terminal.

10. A circuit according to claim 6 wherein the analog multiplier includes a second output transistor connected in parallel with the output transistor.

11. A circuit according to claim 1 further comprising a voltage to current converter having three input terminals for receiving three input voltages and three output terminals coupled to the three input terminals of the analog multiplier for producing the three analog current input signals.

12. A circuit according to claim 1 further comprising a current to voltage converter having an input terminal coupled to the analog output terminal of the analog multiplier for receiving the analog output signal and having an output terminal for producing an output voltage signal.

13. A voltage based analog multiplier circuit comprising:

a voltage to current converter having three input terminals for receiving three input voltages and three output terminal for producing three output currents; and an analog multiplier having three input terminals coupled to the three output terminals of the voltage to current converter for receiving the three output currents and having an analog output terminal for producing an output current that is proportion to two of the current inputs and inversely proportional to a third current input signal, the multiplier including first, second and third input transistors and an output transistor, each transistor having an input terminal, an output terminal and a control terminal, the analog multiplier having a forcing circuit coupled between the input terminal of the third input transistor and the control terminals of the first and second input transistors.

14. A voltage based analog multiplier circuit according to claim 13 wherein the voltage to current converter includes:

an first input transistor having a control terminal coupled to one of the input terminals of the voltage to current converter;

a first current source coupled to the input transistor for biasing the input transistor;

a first current mirror including:

a first mirror transistor, a first pre-bias current source coupled to the first mirror transistor for pre-biasing the first mirror transistor;

a second mirror transistor coupled to the first mirror transistor so that the current through the first mirror transistor is mirrored in the second transistor, a second pre-bias current source coupled to the first mirror transistor for pre-biasing the first mirror transistor; and a resistor coupled between the input transistor and the first mirror transistor so that a current is produced through the resistor responsive to the input voltage received at the control terminal of the first input transistor, the current through the resistor being provided to the first mirror transistor and mirrored by the second mirror transistor to produce an output current corresponding to the input voltage.

15. A voltage based analog multiplier circuit according to claim 14 wherein the first input transistor comprises an emitter follower.

16. A voltage based analog multiplier circuit according to claim 15 wherein the first input transistor comprises a PNP bipolar transistor.

17. A voltage based analog multiplier circuit according to claim 14 wherein the first and second mirror transistors comprise NPN bipolar transistors.

18. A voltage based analog multiplier circuit according to claim 13 further comprising a current to voltage converter having an input terminal coupled to the analog output terminal for receiving the output current and an output terminal for producing an output voltage that is proportional to the output current.

19. A voltage based analog multiplier circuit according to claim 18 wherein the current to voltage converter includes: a first load resistor coupled to the input terminal of the current to voltage converter;

a double emitter follower having an input coupled to the first load resistor and an output; and a second load resistor coupled to the output of the double emitter follower.

20. A voltage based analog multiplier circuit according to claim 13 wherein the forcing circuit includes:

a first emitter follower having an input coupled to the input terminal of the third input transistor and an output;

a current source coupled to the output of the first emitter follower for biasing the first emitter follower; and a second emitter follower having an input coupled to the output of the first emitter follower and an output coupled to the bases of the first and second input transistors.

21. A voltage based analog multiplier circuit according to claim 13 wherein the analog multiplier further includes:

a first forcing circuit coupled between the input terminal and the output terminal of a first one of the input transistors; and a second forcing circuit coupled between the input terminal and the output terminal of a second one of the input transistors.

22. A voltage based analog multiplier circuit according to claim 21 wherein the first forcing circuit includes:

a first forcing transistor coupled to the input terminal of the first input transistor; and a second forcing transistor coupled to between the first transistor and the output terminal of the first input transistor.

23. A voltage based analog multiplier circuit according to claim 22 wherein the first forcing circuit includes:

a base coupled to the input terminal of the first input transistor, a collector coupled to a first supply voltage terminal, and an emitter; and wherein the second forcing transistor includes a base coupled to the emitter of the first forcing transistor, a collector coupled to the output terminal of the first input transistor, and an emitter coupled to a second supply voltage terminal, and an emitter.

* * * * *

UNITED STATES PATENT AND TRADEMARK OFFICE

CERTIFICATE OF CORRECTION

PATENT NO. : 6,074,082
DATED : June 13, 2000
INVENTOR(S) : Barrie Gilbert

It is certified that error appears in the above-identified patent and that said Letters Patent is hereby corrected as shown below:

Column 1,
Line 7, “no so well” should read -- not so well --.
Line 66, “dual emitter followe” should read -- dual emitter followed --

Column 3,
Line 46, “may then converted” should read -- may then be converted --

Column 5,
Line 11, “An example this” should read -- An example of this --
Line 25, “that is proportion” should read -- that is proportional --
Line 45, “coupled to between” should be -- coupled between --

Column 6,
Line 42, “that is proportion” should read -- that is proportional --
Line 53, “an first input” should read -- a first input --

Signed and Sealed this

Eleventh Day of February, 2003

JAMES E. ROGAN
*Director of the United States Patent and Trademark Office*